United States Patent [19]

Bailey

[11] 3,956,896

[45] May 18, 1976

[54] METHOD AND APPARATUS FOR DISPLACING FLUID

[76] Inventor: Charles A. Bailey, 4156 Marland Drive, Columbus, Ohio 43224

[22] Filed: Apr. 18, 1975

[21] Appl. No.: 569,366

[52] U.S. Cl. ..... 60/545; 60/533

[51] Int. Cl.[2] ..... F15B 7/00

[58] Field of Search ..... 60/533, 536, 538, 544, 60/545

[56] References Cited

UNITED STATES PATENTS

| | | | |
|---|---|---|---|
| 1,931,952 | 10/1933 | Charles | 60/536 |
| 2,402,789 | 6/1946 | Tweedale | 60/398 X |
| 2,554,381 | 5/1951 | Patterson | 60/398 X |
| 2,952,128 | 9/1960 | Highland | 60/533 X |

FOREIGN PATENTS OR APPLICATIONS

| | | | |
|---|---|---|---|
| 220,706 | 8/1924 | United Kingdom | 60/533 |
| 825,731 | 12/1959 | United Kingdom | 60/533 |
| 920,452 | 4/1947 | France | 60/533 |

*Primary Examiner*—Martin P. Schwadron
*Assistant Examiner*—H. Burks, Sr.
*Attorney, Agent, or Firm*—William S. Rambo

[57] ABSTRACT

Fluid within a pressure chamber is displaced and pressurized by reeling a flexible cable or filament into the pressure chamber. A movable piston or similar pressure-responsive member in fluid communication with the chamber is moved by the displacement of fluid in the chamber, so as to perform useful work. The flexible cable or filament is wound on a motor-driven reel located in the pressure chamber.

8 Claims, 3 Drawing Figures

METHOD AND APPARATUS FOR DISPLACING FLUID

BACKGROUND OF THE INVENTION

This invention relates generally to fluid displacement apparatus such as hydraulic pumps, rams or the like, and to methods of displacing fluid under pressure to perform work. More particularly, this invention deals with an improved method and means for displacing fluid through the medium of a flexible cable or the like.

Various machines or apparatus for obtaining a mechanical advantage through the medium of hydraulic pressure have been employed for many years to perform useful work. One of the better known hydraulic tools is the common hydraulic jack which utilizes the movement of a small area piston to displace a relatively larger area piston.

The prime disadvantage of this type of hydraulic jack is that the small piston must move many times the distance moved by the large piston. The distance moved by the pistons is proportional to their cross sectional areas. If a relatively large working stroke is required by the larger of the pistons, then this technique becomes impractical because of the tremendous length of the stroke required by the small piston.

SUMMARY AND OBJECTS OF THE INVENTION

This invention provides a method and means by which fluid may be pressurized and/or displaced within a substantially closed circuit by means of a flexible cable-like piston which may be progressively drawn into and wound or coiled within a fluid-filled pressure chamber, so as to displace fluid under pressure to the pressure-responsive area of a movable, work-performing member. In its more specific aspects, the present invention comprises an hydraulic pressure chamber which is in fluid communication with a movable hydraulic piston, ram, or motor, and in which chamber is positioned a motor-driven, cable-winding drum or reel. A flexible cable or filament is arranged to extend through a pressure-sealed opening into the pressure chamber and to be progressively wound or wrapped onto the drum or reel so as to displace hydraulic fluid toward the working face of the hydraulic ram or motor.

The principal object of this invention is to provide improved hydraulic work-performing apparatus in which the fluid-displacing element takes the form of a flexible member which may be progressively wound or coiled into a pressure chamber, so as to displace fluid therefrom in a steady, continuous uninterrupted manner.

At the outset it was recognized that the primary problem encountered when using a flexible piston would be the maintenance of a uniform diameter or cross-sectional area for the piston. It is clear that to control the length of displacement of the larger piston one must be able to anticipate what length of smaller flexible body must be drawn into the fluid chamber. Accordingly, the "flexible" piston must be flexible but not elastic or compressible, in that, one rotation of the reel to draw a given length of the flexible body into the fluid chamber will have a predictable result in terms of the displacement of the larger piston. If the flexible smaller piston is elastic, then it will stretch and the displacement of the larger piston will not be readily predictable. Similarly, if the flexible piston is compressible, then it will not displace a predictable volume of fluid upon one turn of the reel.

Another problem is maintaining the hydraulic seal around the moving flexible piston such that hydraulic fluid and pressure are not lost due to "necking down" of an elastic type of body. To provide a proper seal in the aperture around the smaller piston, the piston should have a uniform cross-sectional area as well as a smooth periphery. To achieve these desired physical characteristics, a multiple strand, steel wire cable encased in a sheath of plastic material, such as polyvinyl chloride, is preferred. The sheath surrounding the stranded cable should be as thin as possible to enhance its flexibility while at the same time minimizing deformation and compressibility of the plastic sheath. However, it is possible that a single strand or monofilament of a highly ductile metal or synthetic resin composition might be used as the flexible piston member. The composition of the flexible piston is not critical so long as it is sufficiently strong, flexible and incompressible.

Figure 1:
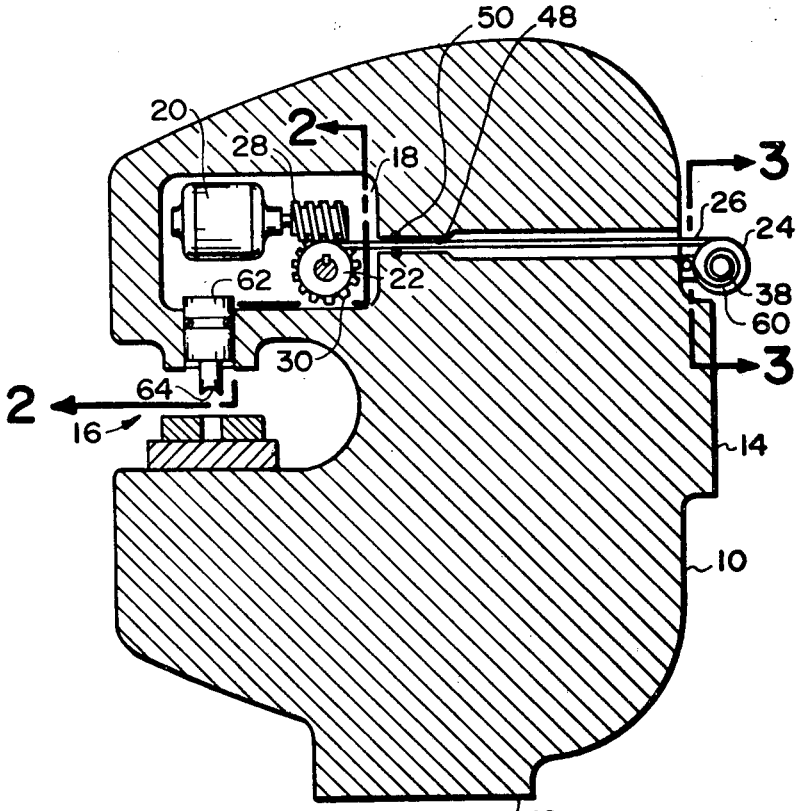
FIG. 1 is a diagrammatic sectional view of a C-frame punch press incorporating the invention.
Figure 2:
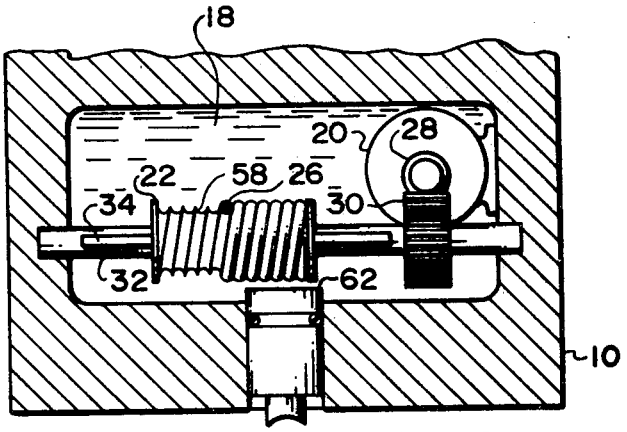
FIG. 2 is a fragmentary sectional view taken along line 2—2 of FIG. 1.
Figure 3:
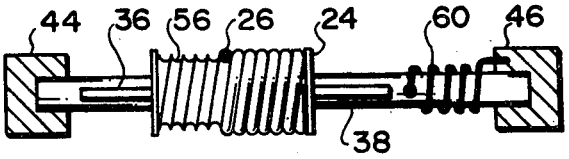
FIG. 3 is a sectional view taken along line 3—3 of FIG. 1.
Figure 1:
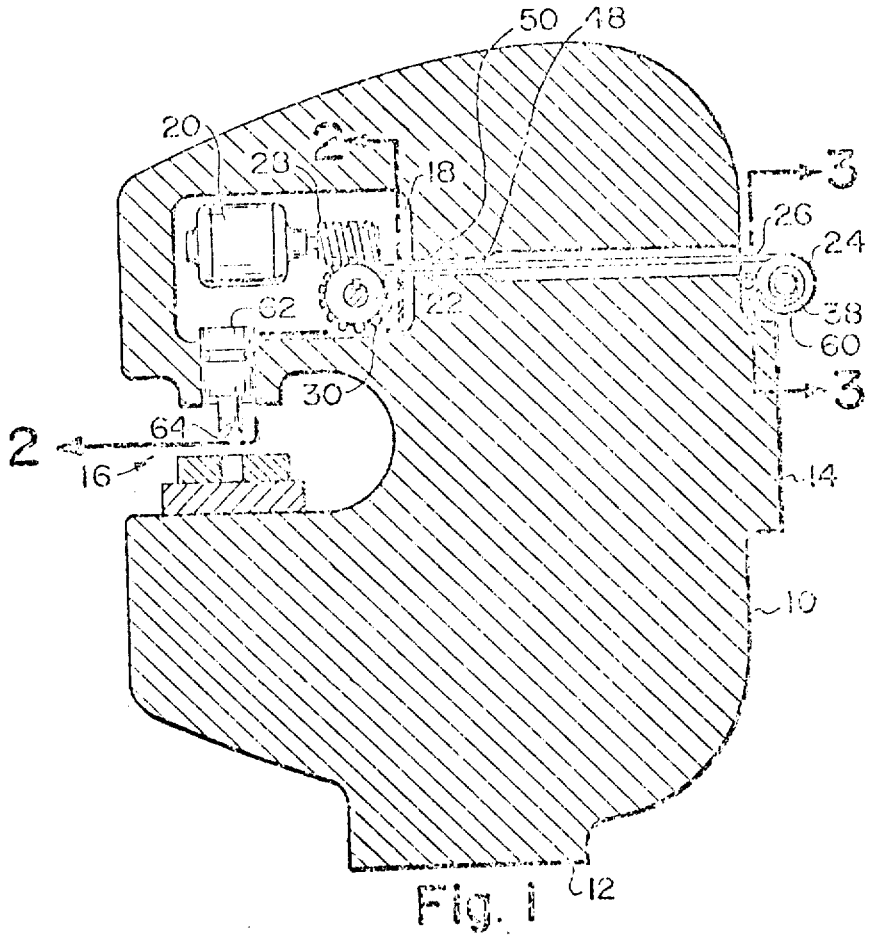
Figure 2:
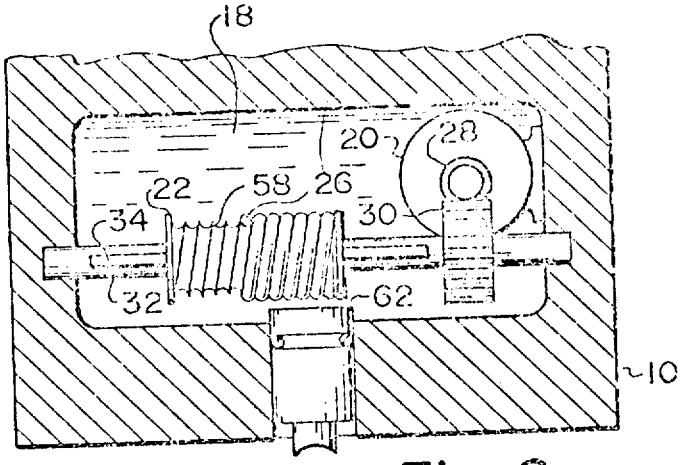
Figure 3:
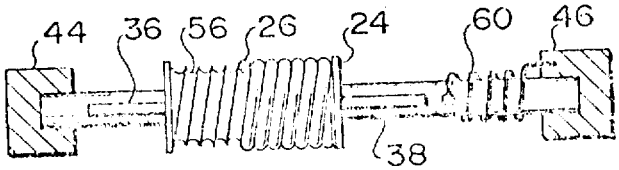

DESCRIPTION OF PREFERRED EMBODIMENT:

Referring to FIG. 1, a C-frame 10 for a punch press or similar work-performing apparatus is shown. The frame 10 is provided with mounting pads 12 and 14 for optionally securing the frame either in an upright or a horizontal position on a foundation or substrate, not shown. The frame 10 includes a work-receiving slot or opening in which is positioned conventional punching apparatus indicated generally at 16.

A fluid-tight enclosure or pressure chamber 18 is formed or otherwise provided in the C-frame and is filled with a suitable hydraulic fluid. Positioned in the pressure chamber 18 is an electric motor 20 and a cable-winding drum, spool, or reel adapted to be driven in axial rotation by the motor 20. Mounted externally of the pressure chamber 18 is a cable supply and rewind reel 24. An elongated, flexible, but substantially incompressible, cable-like body or piston 26 has its opposite ends connected to the reels 22 and 24, and is arranged to be drawn from the reel 24 and wrapped or wound about the reel 22 upon operation of the motor 20. Alternatively, the flexible cable-like body or piston 26 may be rewound from the reel 22 back onto the reel 24, as will be hereinafter more fully explained.

The motor 20 drives a worm 28 which meshes with a worm gear or pinion 30 fixed to an axle shaft 32 on which the reel 22 is mounted. The reel 22 is preferably drivingly connected with the axle shaft 32 by means of an elongated spline or key 34 which provides for unified rotation of the reel with the axle shaft, while at the same time permitting the reel to move axially along the axle shaft. Similarly, the supply and rewind reel 24 is drivingly connected by means of an elongated spline or key 36 with an axle shaft 38 whose opposite ends are journalled in bearing blocks 44 and 46.

As will be readily apparent, the electric motor 20 may, alternatively, be located exteriorly of the hydraulic pressure chamber and connected by any suitable transmission and pressure-sealed shaft means to drive the reel 22 in rotation. Regardless of the position of the motor means 20, a reversible motor in combination with a reverse-locking worm and pinion is preferred, so that the reel 22 may be locked or held by the worm and pinion against fluid pressure-induced reversal when the motor is deenergized.

The technique used in this invention to move the flexible piston member 26 into the pressure chamber is entirely different from conventional methods, wherein a rigid piston is "pushed" into the pressure chamber. In this case, the piston is flexible and it must be "pulled" into the pressure chamber under tension. As a consequence, it is desirable that the flexible piston 26 move in substantially a straight line from the supply reel 24 through an aperture 48, a sealing means 50, and to reel 22. Straight line movement minimizes flexing and friction. Accordingly splines 32 and 36, or other equivalent mechanical adjusting means, may be used to cause the reels 22 and 24 to move axially back and forth on their axles during reeling operations to insure a smooth and uniform wrapping of the piston on the reels. External helical grooves 56 and 58 may be provided on the reels 24 and 22, respectively, to insure an initial smooth cable wrap thereon.

A reciprocative fluid-pressure-responsive piston 62 has one end thereof disposed in fluid communication with the pressure chamber 18 and is arranged to be moved outwardly as the piston 26 is drawn into the pressure chamber. A punch 64 is connected to the opposite end of the piston 62.

A torsion spring 60 shows illustratively one technique for withdrawing the flexible piston 26 from the chamber 18 after the large piston 62 has completed its working stroke. It may be that two synchronized motors will be preferable in many operative techniques to rotate the axles 40 and 42 supporting the reels. In such a case, the trailing reel might be slightly "ahead" of the pulling reel, but whether two motors would be necessary would depend on many factors, including available space at the operating site.

EXAMPLES

With a punch press such as is illustrated in FIG. 1, a piston 62 having a 3 inch diameter is provided and the flexible piston 26 has a diameter of one-quarter inch. The displacement ratios are 144:1. More specifically, 144 inches of flexible body 26 must be drawn into the chamber 18 to displace the piston 62 downward 1 inch.

With the above parameters, in punching a ½ inch hole through a ½ inch thick plate of steel (1020), the force generated must exceed the shear strength of the steel, 35,000 psi. In such punches, it is conventional to grind them such that only 50% of the effective area is in shear at any one time, and using the dimensions and physical properties enumerated above, the equation for calculating the required force is as follows:

$$(1)\ \text{OUTPUT FORGE REQ'D.} = 50\% \times \pi \times 0.50 \text{ dia.} \times 0.50 \text{ thick} \times 35{,}000 \text{ psi} = 13{,}744.47 \text{ lbs.}$$

For purposes of convenience at this point in the example, it will be assumed that operations are at ideal conditions without friction. Thus, the tension in the flexible body 26 to pull the same into the hydraulic chamber is calculated below:

$$\text{TENSION ON FLEXIBLE PISTON (INPUT FORCE)} = \frac{13744.47}{144} = 95.45 \text{ lbs.} \qquad (2)$$

Assuming the radius from the centerline of flexible piston 26 to the center of drum 22 is 1.5 inches, then $$\text{TORQUE ON DRUM} = \frac{95.45 \times 1.5}{12} = 11.93 \text{ lb.-ft.} \qquad (3)$$

Using a 40-tooth worm gear and a double-threaded worm, the gear drive ratio from motor to drum is 20:1. Allowing 10 percent loss to friction, $$\text{REQ'D. MOTOR TORQUE} = \frac{1.1 \times 11.93}{20} = 0.65615 \text{ lb.-ft.} \qquad (4)$$

EMPLOYING A 3450 RPM MOTOR, $$\text{REQ'D. MOTOR H.P.} = \frac{2\pi \times 0.65615 \times 3450}{33{,}000} = 0.431 \text{ H.P.} \qquad (5)$$

Thus, under the above-specified conditions, this task can be accomplished with a 3450 R.P.M., ½ H.P. motor. Assuming that a ¾ inch stroke of the punch is required to complete the shearing operation, the time required is:

$$\Delta T = \frac{.75 \times 144 \times 20 \times 60}{3 \times \pi \times 3450} = 3.98 \text{ seconds.} \qquad (6)$$

Using a 3450 R.P.M., 1 H.P. motor, this time can be reduced to 1.99 seconds. Further calculations show that the same job can be accomplished with a 3450 R.P.M. ¼ H.P. motor using a 40:1 gear drive ratio with a time of 7.97 seconds The above example serves to illustrate that the inventive concept can be applied to other apparatus and in some cases replace relatively large presses. Not only are such presses large but they are expensive capital equipment items. Using this invention, such presses may be replaced in many instances with a portable tool room item costing only a small fraction of the press cost. These smaller tools can, in many instances, be transported directly to the job. In cases where no power is available, the motor, for many applications, can be replaced with a hand crank. The motor can be electric, air, or any other form of motor or engine or prime mover that produces torque in a rotating shaft.

In the above equation (4) it will be observed that a 10% loss to friction is assumed. It is believed that this is an acceptable figure, recognizing that friction will occur in a system at all moving surfaces, and particularly in the worm-gear interface and the aperture areas immediately surrounding the movable pistons 26 and 62. Further, there will be some drag on drum 22 and flexible piston 26 as a result of the surrounding hydraulic fluid in chamber 18. However, the co-efficient of friction in lubricated surfaces is only about 0.03–0.07. Different friction problems will occur on modified structures incorporating the inventive concept herein, but it will be seen that even if the assumption is larger, for example 20%, the loss to friction according to equation (4) is still such that a ½ horsepower motor will be adequate because the result of equation (5) would still be less than 0.5000 H.P.

The following charts show performance data for different flexible body and output piston sizes when operating with a given input force (flexible body tension). The symbols used to represent the various items and values are as follows:

$D_1$ diameter of flexible piston, inches $D_2$ diameter of output piston, inches $R_h$ hydraulic ratio $\left(\frac{\text{area of output piston}}{\text{area of input piston}}\right)$ $R_d$ gear drive ratio $S_c$ flexible piston stroke, inches $REV_d$ revolutions of reel drum $REV_m$ *revolutions of motor*

H.P. motor horsepower (allowing 10% loss to friction)

$\Delta T$ time required to complete a 1-inch output stroke, seconds $F_1$ input piston, pounds $F_2$ output force, pounds P hydraulic pressure, P.S.I.

$D_1$ = ¼ inch
$F_1$ = 900 lb.
OUTPUT STROKE = 1 inch
P = 18,334 psi

96 TOOTH WORM WHEEL
1.5 INCH EFFECTIVE DRUM RADIUS
3450 R.P.M. MOTOR

| $D_2$ | $R_h$ | $S_c$ | $REV_d$ | $R_d$ | $REV_m$ | $\Delta T$ | H.P. | $F_2$ |
|---|---|---|---|---|---|---|---|---|
| 1 | 16:1 | 16 | 1.697 | 48:1(a) | 81.456 | 1.429 | 1.539 | 14,400 |
| | | | | 96:1(b) | 162.912 | 2.833 | .769 | |
| 2 | 64:1 | 64 | 6.79 | 48:1(a) | 325.92 | 5.668 | 1.539 | 57,600 |
| | | | | 96:1(b) | 651.84 | 11.336 | .769 | |
| 3 | 144:1 | 144 | 15.279 | 48:1(a) | 733.38 | 12.754 | 1.539 | 129,600 |
| | | | | 96:1(b) | 1466.77 | 25.509 | .769 | |

NOTE:
(a)with double threaded worm
(b)with single threaded worm

If the above conditions are repeated with 900 pounds tension on a ⅜ inch diameter flexible body and using the same piston area ratio (making the output piston diameters 1.5, 3 and 4.5 inches, respectively) all other values will be the same except that the hydraulic pressure will be 8148.7 P.S.I.

The following chart gives the performance data using 300 pounds of tension on a ⅛ inch diameter flexible body under a different set of conditions:

$D_1$ = ⅛ inch
$F_1$ = 300 lb.
OUTPUT STROKE = 1 inch
P = HYDRAULIC PRESSURE 6111.5

80 TOOTH WORM WHEEL
1-INCH EFFECTIVE DRUM RADIUS
3450 RPM MOTOR

| $D_2$ | $R_h$ | $S_c$ | $REV_d$ | $R_d$ | $REV_m$ | $\Delta T$ | H.P. | $F_2$ |
|---|---|---|---|---|---|---|---|---|
| 0.50 | 16:1 | 16 | 2.546 | 40:1(a) | 101.84 | 1.77 | .41 | |
| | | | | 80:1(b) | 203.68 | 3.54 | .205 | 4800(c) |
| 1.00 | 64:1 | 64 | 10.186 | 40:1(a) | 407.44 | 7.08 | .41 | |
| | | | | 80:1(b) | 814.88 | 14.17 | .205 | 19,200(d) |
| 1.50 | 144:1 | 144 | 22.198 | 40:1(a) | 916.72 | 15.94 | .41 | |
| | | | | 80:1(b) | 1833.44 | 31.89 | .205 | 43.200(e) |

NOTE:
(a)with double threaded worm
(b)with single threaded worm
(c)capable of shearing ½ dia. hole through 1020 steel .174 inches thick
(d)capable of shearing 1-inch diameter hole through 1020 steel .349 inches thick
(e)capable of shearing 1-inch diameter hole through 1020 steel .786 inches thick.

Having thus described the invention as to a preferred embodiment, it will be clear to those having ordinary skill in the art that obvious modifications may be made to the structure without departing from the spirit of the invention. It is not the intention of the inventor to be limited by the single embodiment disclosed nor the language used to describe the same. Rather, it is the intention of the inventor that he be limited only by the scope of the appended claims.

I claim:

1. Apparatus for displacing fluid under pressure comprising:

a. means defining a fluid-filled pressure chamber;

b. a movable pressure-responsive member in fluid communication with said chamber;

c. an elongated, flexible, substantially incompressible piston extending through said means into said pressure chamber; and d. other means in said pressure chamber for progressively drawing said flexible piston into said pressure chamber whereby to displace fluid under pressure therefrom.

2. Apparatus according to claim 1, wherein said other means comprises a rotary reel to which an end of said flexible piston is connected and about which said piston may be wrapped.

3. Apparatus according to claim 1, wherein said piston comprises a flexible cable of substantially uniform diameter.

4. Apparatus according to claim 1, including means connected with said piston exteriorly of said pressure chamber for withdrawing a major portion of said piston from said chamber.

5. Apparatus according to claim 2, including motor means connected to drive said reel in rotation.

6. Apparatus according to claim 2, including a second rotary reel disposed externally of said pressure chamber and having the opposite end of said piston connected thereto.

7. The method of displacing fluid from a confined pressure chamber which is in fluid communication with a movable pressure-responsive member which comprises: progressively drawing into said chamber an elongated, flexible, substantially incompressible body.

8. The method defined in claim 7, which includes winding said flexible body into a coil within said pressure chamber.

* * * * *

UNITED STATES PATENT OFFICE

CERTIFICATE OF CORRECTION

Patent No. 3,956,896 Dated May 18, 1976

Inventor(s) Charles A. Bailey Page 1 of 2

It is certified that error appears in the above-identified patent and that said Letters Patent are hereby corrected as shown below:

Cancel the four sheets of drawings bearing Patent No. 3,956,996, and replace the single sheet of drawings bearing Patent No. 3,956,896, as shown on the attached sheet.

Signed and Sealed this

Second Day of November 1976

[SEAL]

*Attest:*

RUTH C. MASON
*Attesting Officer*

C. MARSHALL DANN
*Commissioner of Patents and Trademarks*